US008210199B2

(12) United States Patent
Popp

(10) Patent No.: US 8,210,199 B2
(45) Date of Patent: Jul. 3, 2012

(54) SILL COCK PROTECTION ARRANGEMENT

(76) Inventor: Joseph Popp, Hobart, IN (US)

( * ) Notice: Subject to any disclaimer, the term of this patent is extended or adjusted under 35 U.S.C. 154(b) by 298 days.

(21) Appl. No.: 12/624,227

(22) Filed: Nov. 23, 2009

(65) Prior Publication Data

US 2011/0120573 A1 May 26, 2011

(51) Int. Cl.
*F16L 5/00* (2006.01)
*F16K 35/00* (2006.01)

(52) U.S. Cl. ..... 137/360; 251/90; 251/95; 251/98; 251/100

(58) Field of Classification Search ..... 137/357, 137/360; 251/93, 95, 98, 101, 103, 107, 251/90, 100, 279, 293
See application file for complete search history.

(56) References Cited

U.S. PATENT DOCUMENTS 676,221 A * 6/1901 Davis ..... 169/19
967,524 A * 8/1910 Kellar ..... 251/100
1,379,927 A * 5/1921 Kneass ..... 251/95
1,438,016 A * 12/1922 Bourke ..... 74/503
1,517,224 A * 11/1924 Walsh ..... 251/149.2
4,700,732 A 10/1987 Francisco
5,056,954 A 10/1991 Flux et al.
5,603,347 A * 2/1997 Eaton ..... 137/360
6,568,654 B1 5/2003 Michna et al.
6,668,852 B1 12/2003 Williamson
2004/0069346 A1 4/2004 Adrian

* cited by examiner

*Primary Examiner* — John Rivell
*Assistant Examiner* — Kevin Murphy
(74) *Attorney, Agent, or Firm* — Greer, Burns & Crain, Ltd.

(57) ABSTRACT

An arrangement for protecting a sill cock on the outside of a building structure from damage caused by water freezing in the sill cock includes an actuating rod extending through an exterior building wall having a handle disposed on its outer end with its inner end coupled to an inner valve in the sill cock's water line. Manually moving the rod by means of the handle in a first direction opens the inner valve allowing water to flow into the sill cock, while moving the rod in a second opposed direction prevents water from flowing to the sill cock to prevent damage to the sill cock by water freezing therein. A drain line with a second outer valve coupled to the water line outside of the building allows for draining water from the sill cock water line when the inner valve is closed.

6 Claims, 2 Drawing Sheets

SILL COCK PROTECTION ARRANGEMENT

FIELD OF THE INVENTION

This invention relates generally to water outlets on an outer wall of a building structure, and is particularly directed to an arrangement for protecting a sill cock from damage caused by freezing water.

BACKGROUND OF THE INVENTION

A sill cock is a water faucet placed at about window sill height on the outside of a building and is generally threaded for attachment to a hose. The typical sill cock is connected to a water line within the building and includes a manually operated valve for discharging water outside an exterior wall of the building. In some installations, a second manually operated valve is positioned within the building and is coupled to a water supply pipe for turning off the water flow to the sill cock. This second interior valve is intended to protect the sill cock and associated pipes from damage caused by the expansion of freezing water within either the sill cock or its associated water pipes. However, the interior water valve is frequently difficult to access and typically overlooked when exterior water systems of a building are shut down when cold weather arrives to protect the sill cock and its associated pipes from freezing water damage. Moreover, even when the interior valve in a water system is closed, water may remain in the exterior end portion of the pipe if the sill cock remains closed or the water pipe does not slope downwardly as it exits the building to the outside.

The present invention addresses the aforementioned problems encountered in the prior art by providing an arrangement for closing an interior valve and shutting off the water flow to an exterior sill cock located on the side of the building from a location outside of the building and adjacent to the sill cock. A discharge pipe with a manually operated outer control valve is also connected to an exterior portion of the water pipe adjacent to the sill cock to ensure drainage of water from the exterior pipe coupled to the sill cock when the interior valve is closed.

OBJECTS AND SUMMARY OF THE INVENTION

Accordingly, it is an object of the present invention to prevent damage to a sill cock caused by the formation of ice therein.

It is another object of the present invention to provide an outside water shut-off capability of an interior water supply valve for a sill cock located on an outer wall of a building which prevents possible damage to the sill cock and associated piping by water freezing therein.

Yet another object of the present invention is to provide an arrangement for internally shutting off the water supply to a sill cock attached to an outer wall of a building from outside of the building, and draining any residual water from the sill cock and associated piping for protecting the sill cock and associated piping from water freezing damage.

A further object of the present invention is to provide an arrangement which allows for controlling from a single position located outside of a building structure (1) the flow of water through a sill cock located outside an exterior wall of the building structure; (2) the flow of water in a water pipe located within the building structure to the sill cock; and (3) the draining of water from the water pipe connected to the sill cock when the sill cock is closed.

The present invention contemplates an arrangement for protecting a sill cock disposed on the outside of a building and coupled to a water supply pipe from damage by freezing water, the arrangement comprising: a first valve coupled to the water supply pipe within the building; a control arm having a first end coupled to the first valve and extending outside of the building, the control arm further having a second opposed end disposed outside of the building and adjacent to the sill cock for allowing water flow to the sill cock to be controlled by opening and closing the first valve; and a second valve disposed outside of the building and adjacent to the sill cock and coupled to a section of the water supply pipe between the first valve and the sill cock for draining water from the water supply pipe when the sill cock is closed.

BRIEF DESCRIPTION OF THE DRAWINGS

The appended claims set forth those novel features which characterize the invention. However, the invention itself, as well as further objects and advantages thereof, will best be understood with reference to the following detailed description of a preferred embodiment taken in conjunction with the accompanying drawings, where like reference character identified like elements throughout the various figures, in which:

DETAILED DESCRIPTION OF THE PREFERRED EMBODIMENTS

Figure 1:
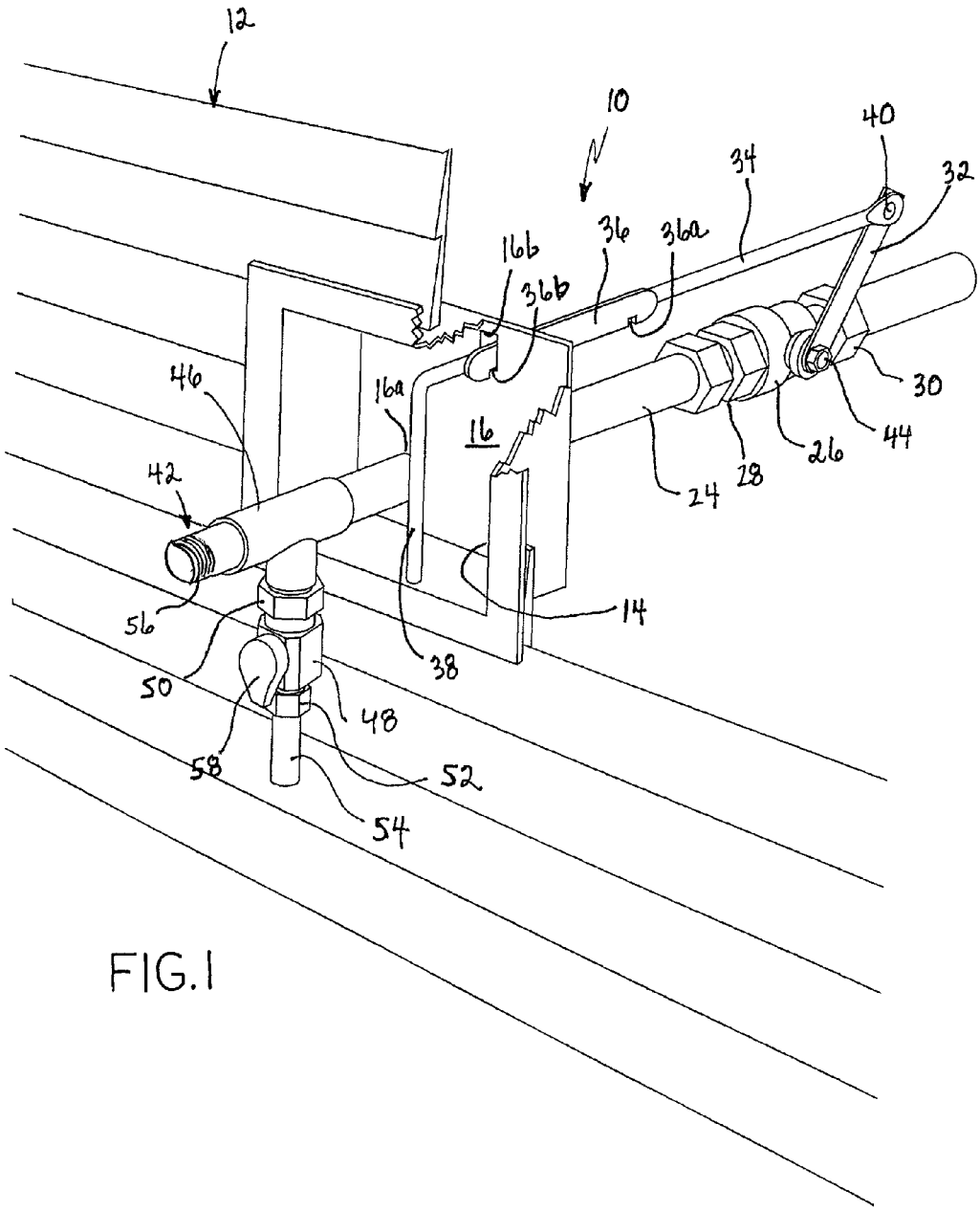
FIG. 1 is a partially cutaway perspective view of a sill cock protection arrangement in accordance with the principles of the present invention.
Figure 2:
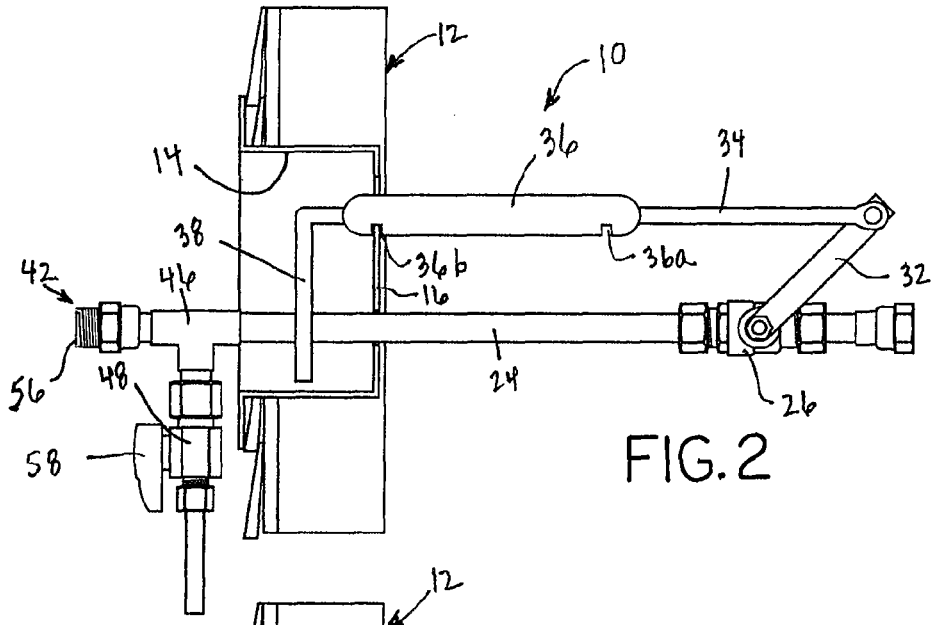
FIG. 2 is a side elevation view of the sill cock protection arrangement of the present invention shown in the closed position wherein water flow is prevented from reaching the sill cock.
Figure 3:
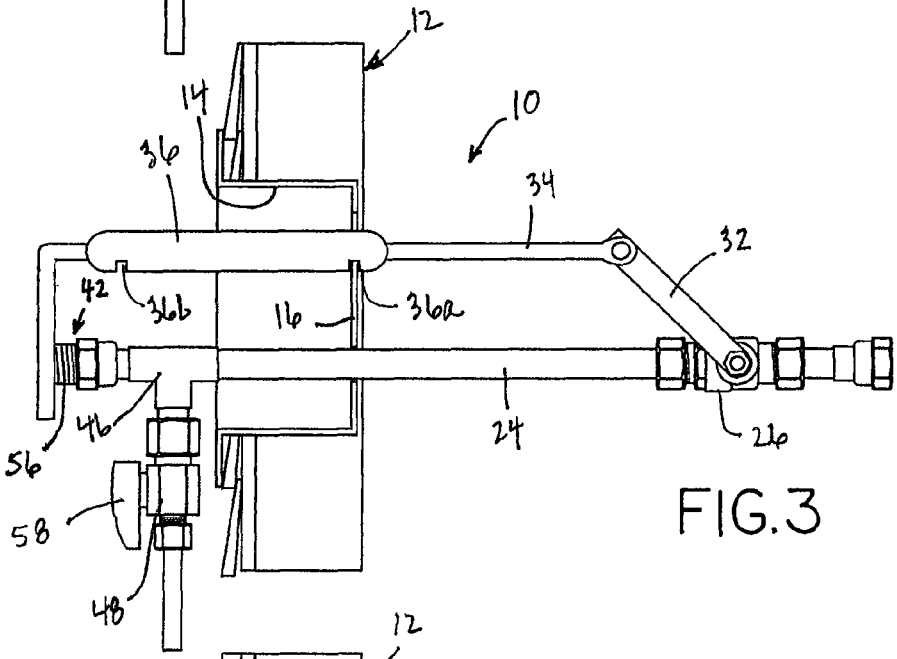
FIG. 3 is a side elevation view of the sill cock protection arrangement of the present invention shown in the full open position where water flow is provided to the sill cock.
Figure 4:
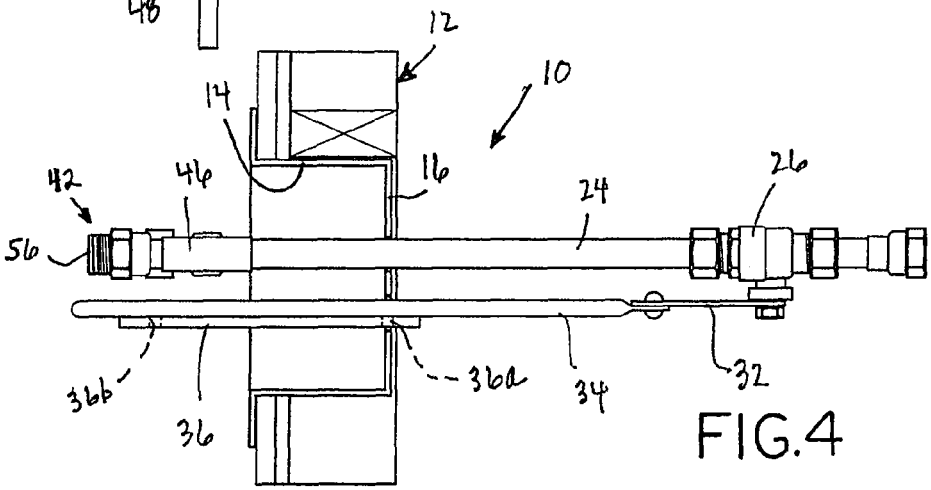
FIG. 4 is a top plan view of the sill cock protection arrangement as shown in the full open position of FIG. 3.

Referring to FIG. 1, there is shown a perspective view of a sill cock protection arrangement 10 in accordance with the present invention shown extending through an outer wall 12 of a building structure. FIGS. 2 and 3 are side elevation views of the sill cock protection arrangement 10 of FIG. 1 respectively illustrating the sill cock protection arrangement in the water shut off configuration and in the full water flow configuration, respectively. FIG. 4 is a top plan view of the inventive sill cock protection arrangement 10 shown in the full open water flow configuration as illustrated in FIG. 3.

The sill cock protection arrangement 10 includes a water pipe 24 extending through an access opening 14 in the outer wall 12 of the building structure. Disposed on an inner portion of access opening 14 is a sealing member 16 having a first aperture 16*a* therein through which the water pipe 24 extends.

Attached to the water pipe 24 at a location within the building structure is a first valve 26. Conventional couplers 28 and 30 and conventional sealing members such as gaskets and washers (not shown in the figure for simplicity) are used to connect the first valve 26 to water pipe 24 in a sealed manner. First valve 26 is typically a ball valve, having a control arm 32 connected to the valve's ball mechanism by means of a conventional coupler 44.

Attached to the outer end of water pipe 24 is a sill cock 42 having a threaded discharge end 56 adapted for coupling to a hose (not shown) in a sealed manner. Attached to water pipe 24 between sill cock 42 and first valve 26 is a T-fitting 46.

T-fitting 46 is connected to water pipe 24 in a sealed manner such as by soldering. T-fitting 46 is further coupled to a second discharge valve 48 by means of a first conventional coupler 50 and to a discharge tube 54 by means of a second conventional coupler 52. The second discharge valve 48 includes a control handle 58 for controlling the flow of water through the second discharge valve. By opening the second discharge valve 48, water within pipe 24 located between the first valve 26 and the sill cock 42 may be drained from the water pipe and discharged exterior to the outer wall 12 of the building structure by means of discharge tube 54. When opened, the second discharge valve 48 prevents residual water remaining in water pipe 24 after the first valve 26 is closed from entering sill cock 42 and possibly damaging the sill cock in the event the water freezes and expands.

Pivotally connected to the distal end of the first valve's control arm 32 by means of pivot pin 40 is an actuating rod 34 of the push-pull type. Disposed on the opposed end of the actuating rod 34 and formed integrally therewith is a handle portion 38 adapted for manual grasping for displacing the actuating rod in a push-pull manner along its length. Actuating rod 34 is positioned within and extends through a second aperture 16*b* within sealing number 16 disposed over the access opening 14. Handle portion 38 is disposed generally transversed to the length of the actuating rod 34 and allows the actuating rod to be easily displaced inwardly or outwardly through the second aperture 16*b* within sealing member 16. Attached to actuating rod 34 and extending partially along the length thereof is an open/close clasp member 36. Clasp member 36 includes first and second slots, or recesses, 36*a* and 36*b* disposed in space relation along the clasp member. Each of these and first and second slots 36*a*, 36*b* is adapted to engage in inner edge of the second aperture 16*b* of sealing member 16 as the actuating rod 34 is either pulled outwardly or pushed inwardly through the second aperture 16*b* in the sealing member. When the actuating rod 34 is pushed inwardly into the interior of the building structure (to the right as shown in the figures), the second slot 36*b* of clasp member 36 is adapted for engaging in interior portion of the sealing member's second aperture 16*b* for maintaining the actuating rod in fixed position for maintaining valve 26 in the fully closed position to prevent water from flowing through water pipe 24 to sill cock 42. This configuration is shown in FIGS. 1 and 2. Similarly, when actuating rod 34 is pulled outwardly through the sealing member's second aperture 16*b*, the first slot 36*a* of clasp member 36 is adapted to engage an inner surface of the sealing member's second aperture 16*b* to maintain the first valve 26 in the full open position to allow water to flow through pipe 24 to sill cock 42. This configuration is shown in FIGS. 3 and 4. It is in this manner that the first valve 26 may be securely maintained in either the full open position or the full closed position with respect to water flow through the valve by means of the combination of actuating rod 34 and open/closed clasp member 36. While the figures show the first valve 26 in the water shut off configuration with the actuating rod 34 and clasp member 36 combination fully inserted through the building structure's outer wall 12, the present invention is not limited to this configuration, as this configuration could also represent the full open position of the first valve. In this latter case, the full closed position of the first valve 26 would be represented by FIGS. 3 and 4 showing the actuating rod 34 and clasp member 36 displaced outwardly through the building structure's outer wall 12.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matters set forth in the foregoing description and accompanying drawings is offered by way of illustration only and not as a limitation. The actual scope of the invention is intended to be defined in the following claims when viewed in their proper prospective based on the prior art.

I claim:

1. An arrangement for protecting a sill cock disposed on the outside of building and coupled to a water supply pipe from damage by freezing water, the arrangement comprising:

a first valve coupled to said pipe within the building;

a control arm having a first end coupled to said first valve and extending outside of said building, said control arm further having a second opposed end outside of the building and adjacent the sill cock for allowing water flow to the sill cock to be controlled by opening and closing said first valve;

a second valve disposed outside of the building and adjacent the sill cock and coupled to the water supply pipe between said first valve and the sill cock for draining water in the water supply pipe between said first valve and the sill cock; and a latch mechanism disposed on said control arm for securely maintaining said first valve in an open position for allowing water to flow via the water supply pipe to the sill cock or in a closed position for preventing water from flowing to the sill cock;

wherein said latch mechanism engages an outer wall of the building for securely maintaining said first valve on the open or closed position, and wherein said latch mechanism includes first and second spaced detents for directly engaging the building's outer wall and maintaining said control arm in an extended or retracted position and said first valve in said open or closed position.

2. The arrangement of claim 1, wherein said control arm is in the form of a first, elongated linear member and said latch mechanism is in the form of a second elongated, linear member coupled to and extending along a portion of the length of the first elongated, linear member, and wherein said first and second detents are disposed in said second elongated, linear member.

3. The arrangement of claim 1 further comprising a handle disposed on the second opposed end of said control arm and adapted for manual engagement for moving said control arm between said open and closed positions.

4. The arrangement of claim 1 further comprising a pivotal coupling connecting the first end of said control arm to said first valve.

5. The arrangement of claim 1, wherein the water supply pipe is inclined downwardly in proceeding from said first valve to said second valve.

6. The arrangement of claim 1 further comprising a T-fitting coupling said second valve to the water supply pipe.

* * * * *